US005673604A

United States Patent [19]

Rigney

[11] Patent Number: 5,673,604

[45] Date of Patent: Oct. 7, 1997

[54] COLLAPSIBLE HOLE PUNCH

[76] Inventor: Douglas Edward Rigney, 789 Charlton Dr., Pleasant Hill, Calif. 94523

[21] Appl. No.: 590,698

[22] Filed: Jan. 25, 1996

[51] Int. Cl.[6] ..... B26F 1/32

[52] U.S. Cl. ..... 83/468.7; 83/167; 83/588; 83/599; 83/620; 30/358; 402/1

[58] Field of Search ..... 83/167, 467.1, 83/588, 620, 468.7, 597, 598, 599, 618, 637, 646, 687, 691; 30/358; 402/1, 4

[56] References Cited

U.S. PATENT DOCUMENTS

| | | | |
|---|---|---|---|
| 2,278,288 | 3/1942 | Sadler | 83/620 |
| 2,389,105 | 11/1945 | Kern | 83/167 |
| 3,087,367 | 4/1963 | Semler | 83/588 |
| 3,387,526 | 6/1968 | Neilsen | 83/588 X |
| 3,469,486 | 9/1969 | Neilsen | 83/588 X |
| 3,485,130 | 12/1969 | Neustadter et al. | 83/588 X |
| 3,987,695 | 10/1976 | Neilsen | 83/522 |
| 4,079,647 | 3/1978 | Elder et al. | 83/441.1 |
| 4,166,404 | 9/1979 | Almong | 83/167 |
| 4,669,191 | 6/1987 | Schramm | 30/358 |
| 4,742,744 | 5/1988 | Lindberg | 83/167 |
| 4,823,661 | 4/1989 | Freres | 83/620 X |
| 4,869,143 | 9/1989 | Merrick et al. | 83/467.1 |
| 5,291,813 | 3/1994 | Blumenthal et al. | 83/599 |
| 5,340,229 | 8/1994 | Schwartzman | 83/620 X |
| 5,386,638 | 2/1995 | Weber | 30/358 |
| 5,490,440 | 2/1996 | Karlis et al. | 402/1 X |
| 5,503,052 | 4/1996 | Rigney et al. | 83/467.1 |

FOREIGN PATENT DOCUMENTS

| | | | |
|---|---|---|---|
| 3339742 | 5/1985 | Germany | 83/167 |

*Primary Examiner*—Eugenia Jones

[57] ABSTRACT

A compact hole punch for manually punching holes through sheet-like material to produce hole sets which enable the material to be mounted on multi-ring binders. The hole punch includes male and female plates, which in operation move convergently between an open position and a collapsed position and are retained in a parallel relative orientation by pivotally mounted support posts and a spring. The male plate carries a plurality of punch pegs while the female plate carries corresponding die openings through which the punch pegs penetrate to cut the holes in the material when the plates are pressed together. An adjustable slide member is removably mounted on the female plate for engagement with the posts to lock the hole punch in the collapsed position. The slide member also acts as an adjustable stop guide for positioning the material within the hole punch. A side edge of a pivotally mounted post engages in scissors-like fashion a juxtaposed edge portion of a plate thus providing a cutting functionality during the convergent movement of the plates.

6 Claims, 7 Drawing Sheets

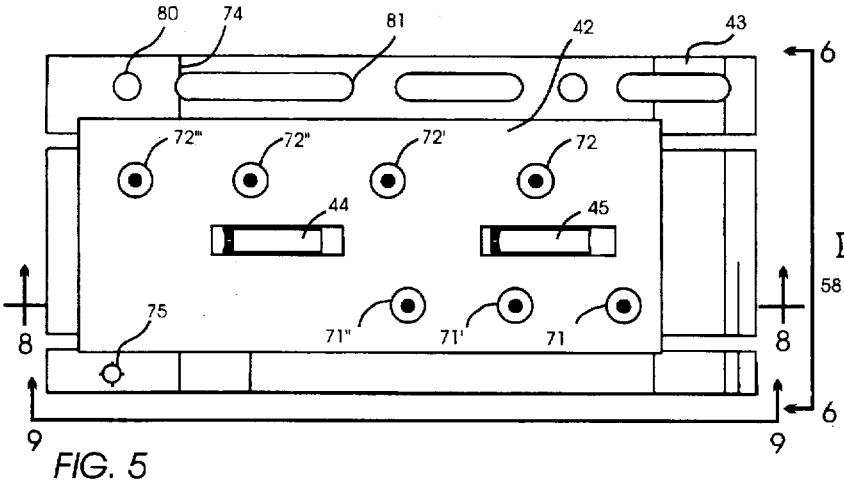
FIG. 5
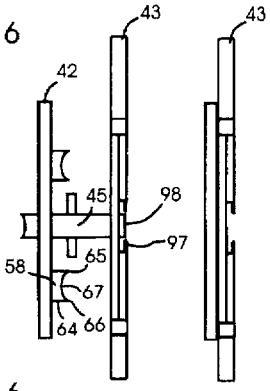
FIG. 6
FIG. 7
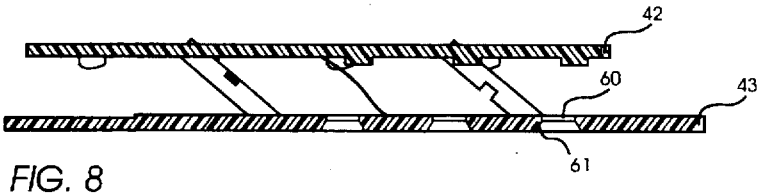
FIG. 8
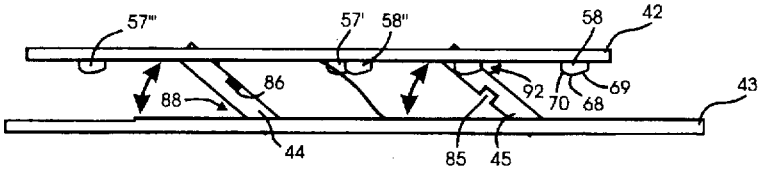
FIG. 9
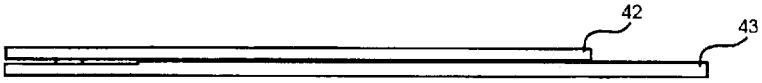
FIG. 10

COLLAPSIBLE HOLE PUNCH

BACKGROUND OF THE INVENTION

1. Field of the Invention

This invention relates in general to devices for punching holes through paper, cards, or other sheet-like material to be mounted on multi-ring binders. More particularly, the invention relates to compact, light-weight punching devices.

2. Description of the Prior Art

A wide variety of multi-ring binders, such as day planners, organizers and notebooks, are commonly employed for mounting cards, paper sheets, plastic jackets or other sheet-like material. The binders are provided with a spine containing reversible mounting rings for holding the sheets and with covers for protecting the mounted sheets. The binders are available in a variety of sizes. The ring pattern arrangement is also varied with binders containing 3, 6, and 7 rings being commonly available. The 6-ring binders, for example, typically consist of 2 sets of 3 closely spaced rings with a larger space between the pair of sets. Seven-ring binders typically have a pair of 3-ring sets and a single ring centrally located between the sets.

Pre-punched sheets are commercially available for the various binders. However, a user wishing to mount his own paper, photos, cards or other sheet-like material must obtain a hole punch capable of creating the corresponding pattern of holes. In addition, when one graduates from one size binder to another, a different hole punch must be used.

Numerous punch devices exist for placing holes in paper for mounting in notebook binders. Typically, these devices are not adjustable or have limited adjustability of the punch pattern. Due to their weight and size, these devices are primarily intended for use on the desk top. Additionally, existing punch devices only carry out the single function of punching holes, thus necessitating the acquisition of additional devices or implements for other common manipulations of sheet-like material such as cutting.

3. Objects of the Invention

Accordingly, it is the general object of the present invention to provide a punch for sheet-like material which will produce a variety of punch patterns corresponding to differing ring patterns encountered in various multi-ring binders.

It is another object of the present invention to provide a punch which is lightweight and of simple design.

It is yet another object of the present invention to provide a punch which is collapsible to a thin and compact size capable of being carried within a notebook or other otherwise conveniently transported and stored.

It is yet a further object of the present invention to provide a punch which incorporates the additional functionality of cutting sheet-like material in scissors-like fashion.

The foregoing and additional objects and features of the invention will appear from the following specification in which the several embodiments have been set forth in detail in conjunction with the accompanying drawings.

SUMMARY OF THE INVENTION

The present invention provides a hole punch for manually punching holes through paper, cards or other sheet-like material for mounting on multi-ring binders. The punch is comprised of a male plate which carries a plurality of punch pegs and an adjacent female plate possessing a plurality of corresponding die openings. The plates are maintained parallel and overlapping by movable support members which permit lateral convergent movement of the plates for inserting the punch pegs into respective die openings in order to punch holes in the material. In one embodiment, the male and female plates are maintained parallel by a plurality of posts pivotally mounted at their ends to the facing plates. Resilient means are provided for biasing the plates to return to an open position in which the plates are apart. In operation, the posts and resilient means constrain the motion of the plates during their convergent movement toward a collapsed position in which the pegs engage the corresponding die openings in order to produce a pattern of punched holes in an inserted sheet. In another embodiment, the female plate carries a movable locking member for retaining the plates in the collapsed position in order to facilitate storage of the punch. In yet another embodiment, the movable locking member carries guide means for facilitating selective placement of the hole sets to be cut by the punch pegs. In still yet another embodiment, a side edge of a pivotally mounted post engages in scissors-like fashion a juxtaposed edge portion of a plate thus providing a cutting functionality during the convergent movement of the plates.

BRIEF DESCRIPTION OF THE DRAWINGS

FIG. 5 is a top plan view of the hole punch of FIG. 1.

FIG. 6 is an end view of the hole punch taken along the line 6—6 in FIG. 5.

FIG. 7 is a view of the hole punch of FIG. 6 in the collapsed position.

FIG. 8 is a cross-sectional view taken along the line 8—8 of the hole punch shown in FIG. 5.

FIG. 9 is a side view of the hole punch in the open position taken along line 9—9 in FIG. 5.

FIG. 10 is a view of the hole punch shown in FIG. 9 in the collapsed position.

DESCRIPTION OF THE PREFERRED EMBODIMENTS

Figure 1:
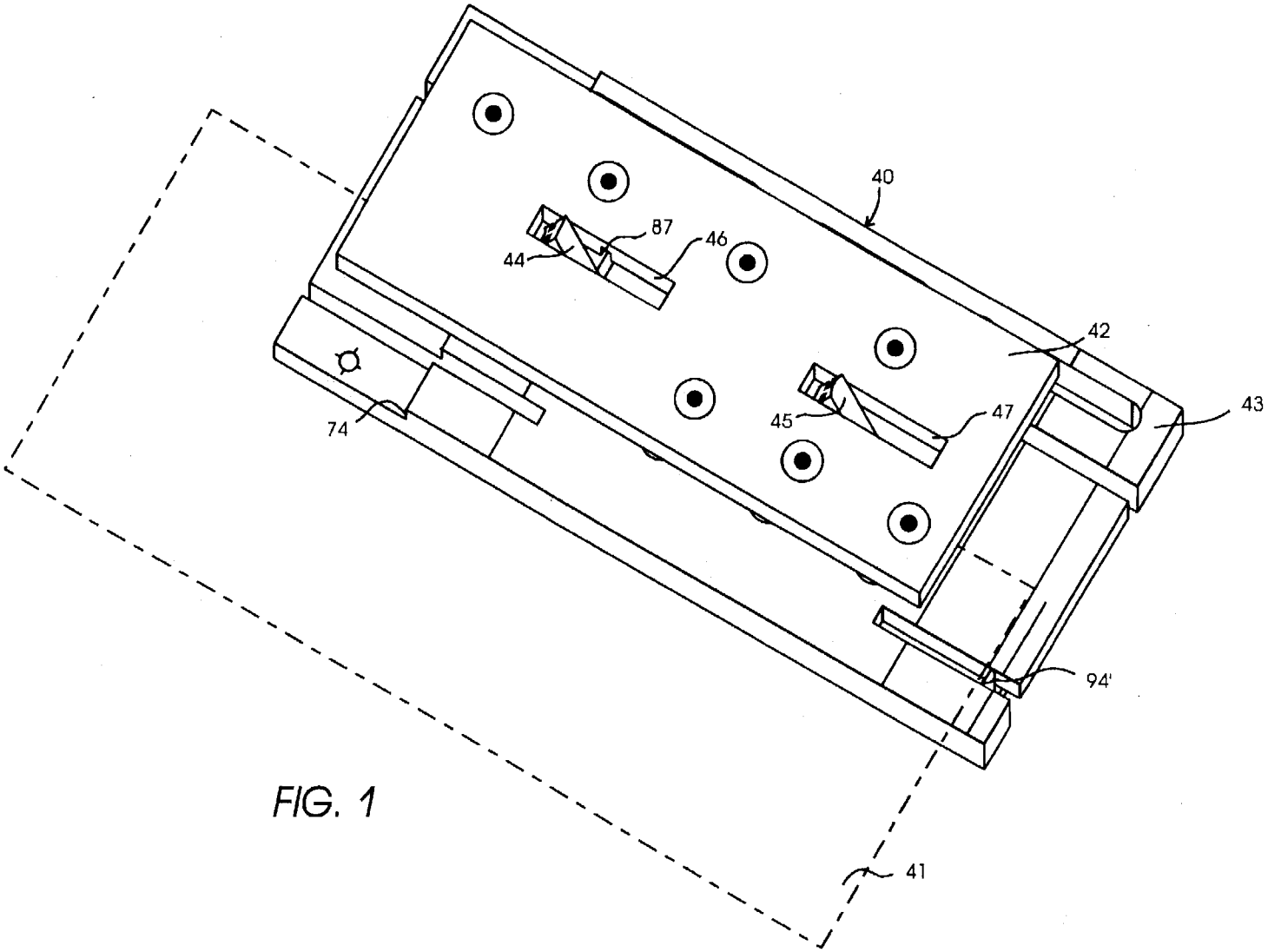
FIG. 1 is a perspective view of a hole punch incorporating one embodiment of the present invention.

In the drawings FIG. 1 illustrates generally at 40 a preferred embodiment of the invention providing a collapsible hole punch for use in manually punching holes through cards, paper or other sheet-like material (as shown at 41) to be mounted on multi-ring binders. The collapsible hole punch is operated by the user to punch hole sets which are sized and oriented to correspond with the rings of different types of commercially available loose-leaf binders.

Figure 2:
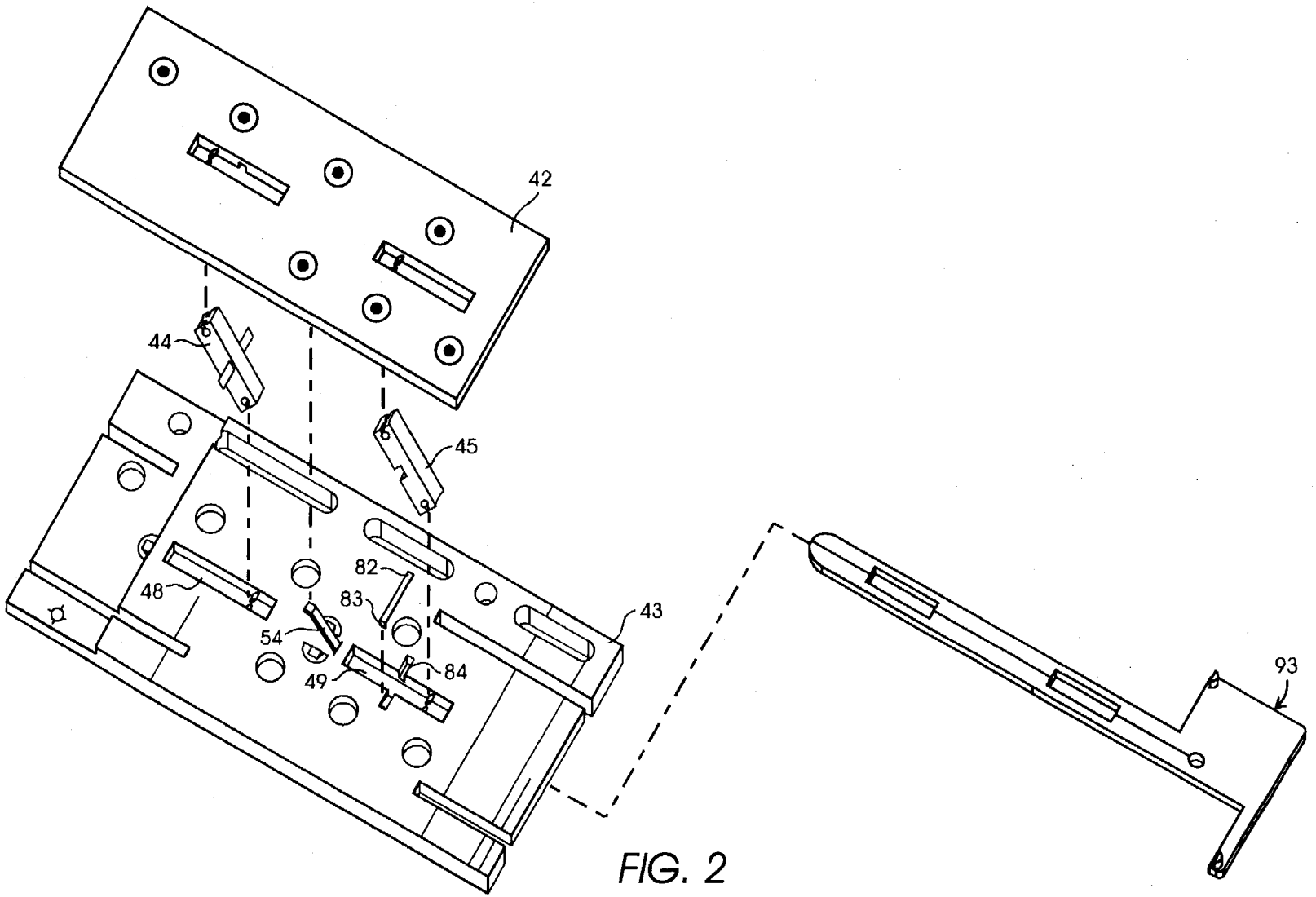
FIG. 2 is an exploded perspective view, to a reduced scale, of the hole punch of FIG. 1.

Collapsible hole punch 40 is comprised of male plate 42 and female plate 43 which are joined together by a front post 44 and a back post 45 for reversible laterally convergent movement of the plates. Each post is pivotally mounted at the top end to the male plate and at the bottom end to the female plate. Longitudinal slots for receiving the posts are provided in the male plate at 46 and 47 and in the female plate as shown in FIG. 2 at 48 and 49.

Figure 3:
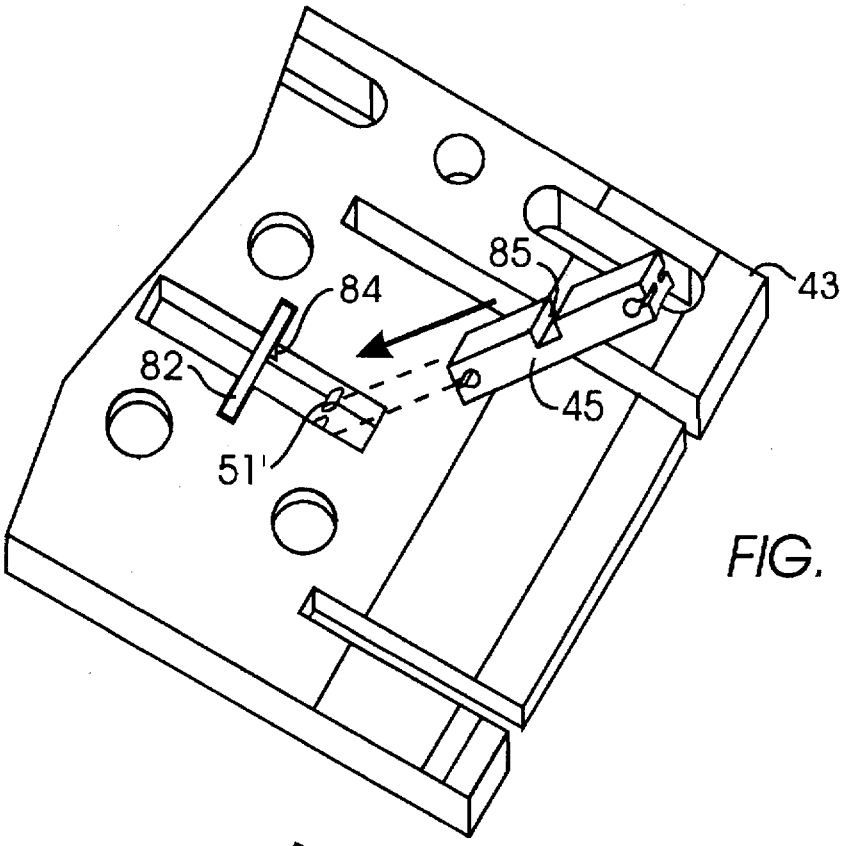
FIG. 3 is a fragmentary view, to an elarged scale, in perspective of the top of the female plate showing insertion of a post onto the pivot pins.
Figure 4:
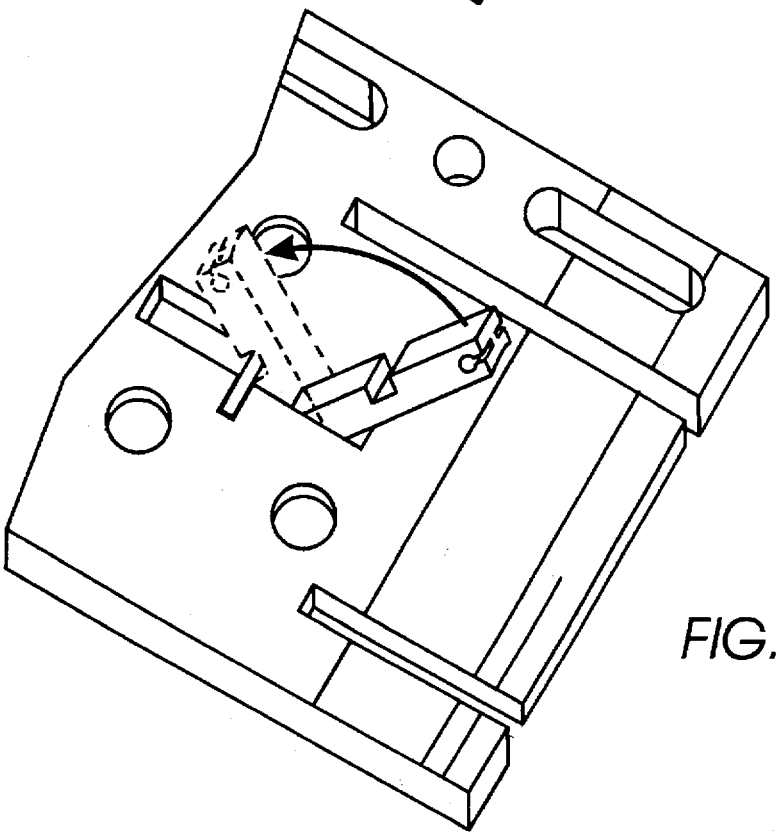
FIG. 4 shows the positioning of the post on the pivot pins shown in FIG. 3.
Figure 11:
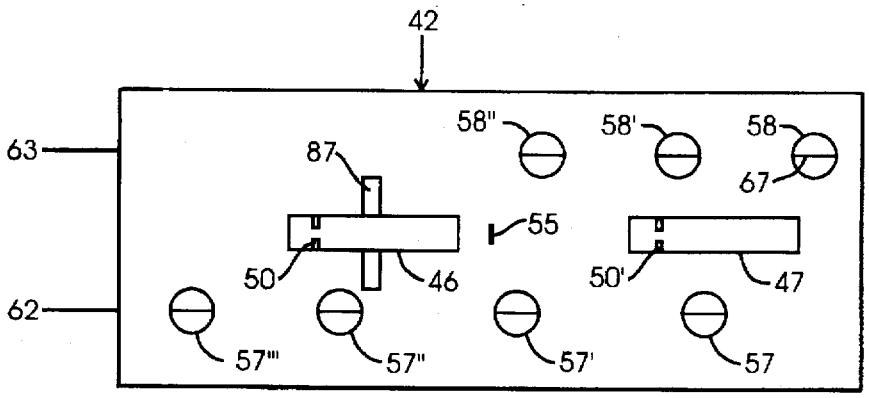
FIG. 11 is a bottom plan view of the male plate of the hole punch shown in FIG. 5.
Figure 12:
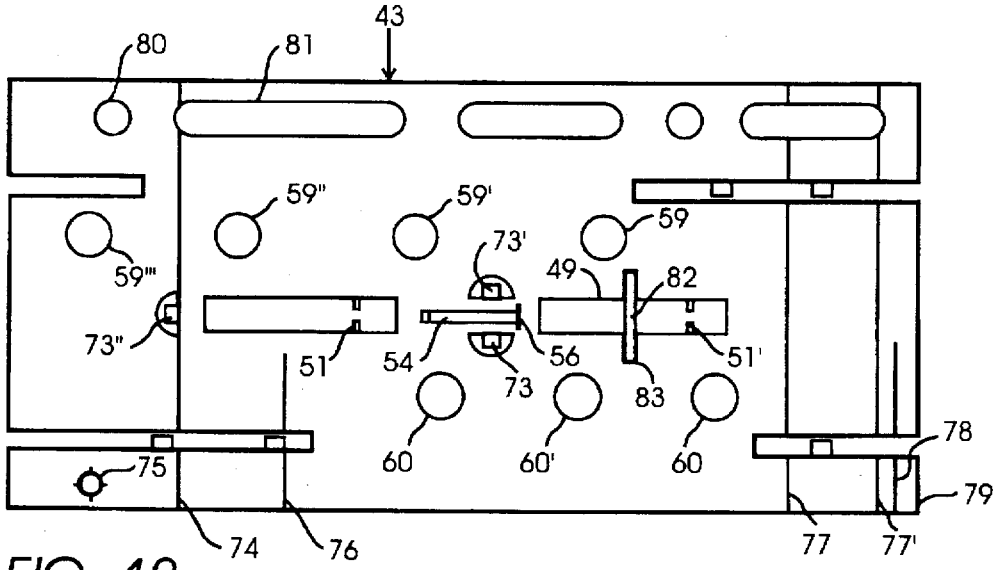
FIG. 12 is a top plan view of the female plate of the device of FIG. 5.
Figure 18:
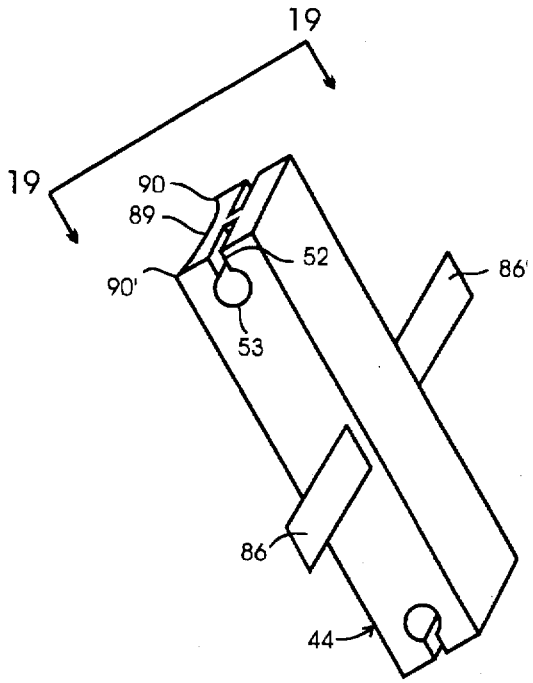
FIG. 18 is an enlarged view of the front post of FIG. 2.
Figure 20:
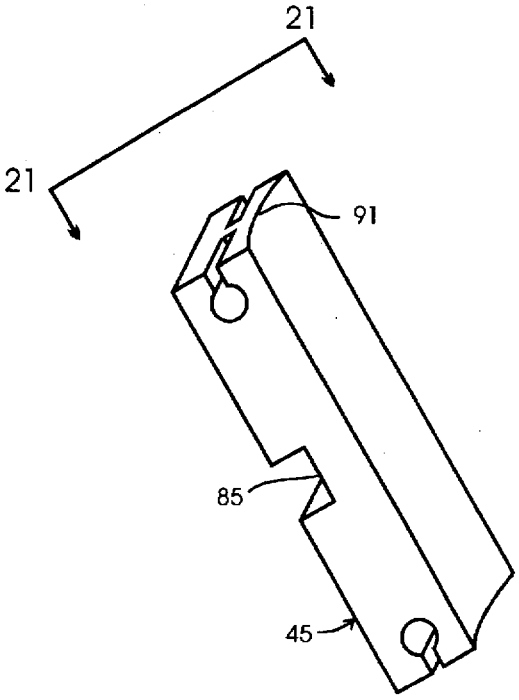
FIG. 20 is an enlarged view of the back post of FIG. 2.

Flattened pivot pins are provided within the elongated slots in both the male plate at 50 and 50' (FIG. 11) and female plate at 51 and 51' (FIG. 12). As seen in FIGS. 2 and 18–20 the posts 44 and 45 are generally rectangular blocks with keyhole-shaped recessions on each side at both ends. As shown in FIG. 18, the keyhole-shaped recessions have an elongated portion 52 and a rounded portion 53. The elongated portion communicates with the end surface of a post and allows insertion onto the pivot pins of the female plate as shown in FIGS. 3 and 4. Forward rotation of a post upon the pins serves to lock the post within the rounded portion 53 of the keyhole-shaped recession. The posts are inserted into the male plate in an analogous manner. The male and female plates and the posts are rigid and preferably made of a suitable synthetic plastic material or of metal.

The male and female plates are positioned in parallel as shown in FIG. 9. Spring 54 is engaged between slots 55 in the male plate (FIG. 11) and 56 in the female plate (FIG. 12). Spring 54 urges the plates to remain in the open position and also limits the backward travel of the male plate relative to the female plate.

In FIG. 11 male plate 42 carries a plurality of punch pegs 57,58 while the female plate 43, shown in FIG. 12, is formed with a plurality of die openings 59,60 which are sized and positioned in corresponding relationship with respective punch pegs. The illustrated embodiment provides a seven-hole punch with a set of four punch pegs and corresponding die openings along one longitudinal side of the hole punch and a set of three punch pegs and corresponding die openings along the other side.

The diameters of the punch pegs and die openings are commensurate with the outer diameters of the rings for the particular binders for which the hole punch is to be used. Typical diameters for the punch pegs are 3/16" or ¼". As seen in FIGS. 11 and 12, the set of three punch pegs 58,58',58" and corresponding die openings have a pitch, ie. center-to-center spacing, of ¾". The set of four punch pegs and corresponding die openings have a pitch of 1" between pegs 57,57', and 57" and a pitch of ¾" between pegs 57",57'''. This combination permits the hole punch to be used with a large variety of commercially available binders. The invention contemplates that other combinations of number of hole sets and pitch dimension could be provided to accommodate the requirements of specific ring binder designs. Another arrangement contemplated by the invention is to provide the set of punch pegs and die openings along only one side of the male plate.

In the preferred embodiment as illustrated in FIG. 8, the die openings on the top surface of the female plate have a straight hole formed with a diameter commensurate with that of the corresponding punch pegs. On the bottom surface, the exit side of the hole is chamfered, as shown at 61, in a manner well known in the art, with outwardly diverging side walls, to facilitate entry of the punch peg, for ease of discharging paper waste or chaff, and to minimize binding of the punch pegs within the die openings.

As best illustrated in FIGS. 6 and 9, the male and female plates are retained in parallel relationship by the posts and spring member. The distance between the plates in the open position is preferably ¼" to ¾". It should be appreciated that as the male plate convergently approaches the female plate the male plate also rotates, as indicated by the curved arrows in FIG. 9, around the pivot points provided by the pivot pins of the female plate (shown at 51 and 51' in FIG. 12). As illustrated in FIG. 8 the die openings must be positioned sufficiently ahead of the corresponding punch pegs in the open position so that the punch pegs will be aligned with the respective die openings when the punch is moved to its collapsed position as shown in FIGS. 7 and 10.

The bottom plan view of the male plate as seen in FIG. 11 shows that the sets of punch pegs are aligned along respective cutting axes 62 and 63 which are parallel to the longitudinal axis. The punch pegs are each formed at their distal ends with crowns, as shown by crown 64 for peg 58 in FIG. 6. The crowns are molded with opposed cutting edges 65,66 which are separated by a U-shaped notch which diverges from a centerline 67 which extends across the diameter of the peg. As illustrated in FIG. 9, the cutting edges of the pegs are contoured with convex peaks 68 which are parallel to the cutting axis.

During the punching operation each punch peg begins its insertion into the entrance side of the die opening. Due to the rotational movement of the male plate around the pivot axes formed by the pivot pins in the female plate, it can be appreciated that the peg movement has a forward component parallel to the longitudinal axis of the punch and a convergent component perpendicular to the longitudinal axis such that the forward portion of the peg enters the die opening ahead of the rear portion of the peg.

As seen in FIG. 9, the profile of a peg reveals that the convex peak 68 occurs ahead of the center of the peg. The rearward angle 69 of a convex peak is seen to be more shallow than the forward angle 70 in order to prevent the cutting edges of a peg from being damaged by contacting the edges of the die opening as the peg enters the die opening. This forward offset of the peak additionally prevents binding of the peg in the die opening as the plates are moved together. In addition, the forward offset of the convex peak provides for a chisel-like effect as the front portion of a peg initially cuts the sheet-like material and a slicing-like effect as the rear portion of the peg cuts through the material. This provides for a clean cut of material around the border edge of the hole as the peg enters the die opening.

As illustrated in FIG. 5, the top surface of the male plate is provided with printed or otherwise marked indicia to indicate the position of the underlying punch pegs to assist the user to visually align the hole punch at the desired punching position over the paper or other sheet-like material. On the side with the set of three punch pegs, the three indicia 71,71',71" are formed in alignment with the respective pegs, and on the opposite side the four indicia 72,72', 72",72''' are formed in alignment with their respective pegs. The indicia are formed directly in alignment with centers of the pegs to provide further aid for use in visually determining the "dead center" position of the punches. The indicia permit the user to identify where the holes will be punched and permit any required lateral movement or adjustment of the sheet-like material.

As shown in FIG. 12 the female plate 43 is provided on its top surface with recessed hooks 73,73',73" which act as edge stop means for releasably stopping movement of the border edges of the sheet-like material, and which prevent the inserted border edges from curling upward, thus facilitating proper alignment with the punch pegs. In order to engage a hook, the user first inserts the sheet-like material at a downward angle in order to slide under a hook. The material is then lowered to rest essentially flat with the top surface of the plate prior to the punching operation.

The front portion of the female plate possesses a ridge 74 which acts in conjunction with a recessed hook 73" as an edge stop means for material inserted from the front of the punch. A guide hole 75 is provided for alignment under a previously punched hole in a portion of sheet-like material so that an additional hole may be punched in the material at the position of die opening 59". The guide hole thus allows the user to punch an additional single hole required for some ringed-binders which have a center ring.

It should also be recognized that the lateral sides of the posts 44,45 (FIG. 2) which are mounted on the pivot pins 51,51' (FIG. 12), respectively, also act in conjunction with the hooks 73,73' as edge stop means for material inserted from the sides of the punch. Transverse lines 76,77,77',78 positioned on the top surface of the female punch plate, as well as the back edge 79, act as guides for assisting in positioning the sheet-like material along the longitudinal axis of the punch in order to make punch patterns in the material corresponding to the positions of rings in a particular binder.

A plurality of apertures 80,81 (FIG. 12) are formed along one side of the female plate and sized and positioned for mounting on the rings of a variety of binder designs. When so mounted, the punch may be stored conveniently and is available for use while still mounted on the rings.

As shown in FIGS. 2 and 12, a transverse resilient member 82 is located in the top surface of the female plate. One end 83 of the transverse spring member is mounted within a transverse relief cavity 84 which is located along the longitudinal axis of the slot 49. The back post 45 is provided on one side with a centrally located notch 85 (FIG. 20) which engages the transverse spring member when the punch is fully collapsed, thus providing an additional resistive force between the male and female plates, in order to prevent the binding of the pegs within their corresponding die openings and to urge the two plates open to a ready to use position.

Figure 19:
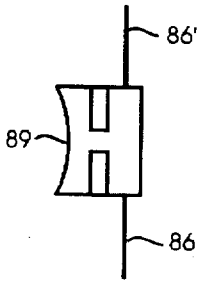
FIG. 19 is an end-on view of the post of FIG. 18 taken along line 19—19.

As seen in FIG. 2, the post 44 which pivots within the front slot 48 is provided with a centrally located flat resilient member mounted transversely to produce wing-like resilient members 86,86' (FIGS. 18 and 19). In operation, these wing-like resilient members engage the bottom surface of the male plate in a second relief cavity 87 (FIGS. 1 and 11) located transversely to the longitudinal axis of the front slot in the bottom surface of the male plate. The wing-like resilient members act to provide additional resistive force between the male and female plates when the punch is in its fully collapsed position in order to prevent the binding of the pegs within their corresponding die openings and to urge the two plates open to a ready to use position.

An additional feature of each post is a scissors-like action associated with the side surfaces of a post which move in juxtaposition to the sides of its respective slot. Considering the front post 44 in FIG. 9, lateral convergent movement of the male plate towards the female plate would cut a sheet of material placed at position 88 under the post as the post rotates into slot 48 (FIG. 2) along the top surface of the female plate.

Figure 21:
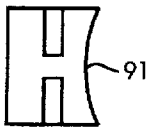
FIG. 21 is an end-on view of the post of FIG. 20 taken along line 21—21.

As shown in FIGS. 18 and 19, in the preferred embodiment, the surface 89 of the post 44 which faces into slot 48 is concave and has sharpened edges 90,90' to facilitate the cutting action. In operation, a narrow strip of the sheet-like material is produced during the cutting process. Similarly, the back post 45 is provided with a concave surface 91 (FIGS. 20 and 21) which faces into slot 47 of the male plate (as seen in FIG. 1) and would cut a sheet of material placed at position 92 (FIG. 9).

The punch is further provided with a T-shaped member 93 as seen in FIG. 2. The top surface of the head of the T-shaped member has guide pegs 94,94' (FIG. 15) protruding upward. The body of the T-shaped member has elongated openings 95,95' (FIG. 14).

Figure 13:
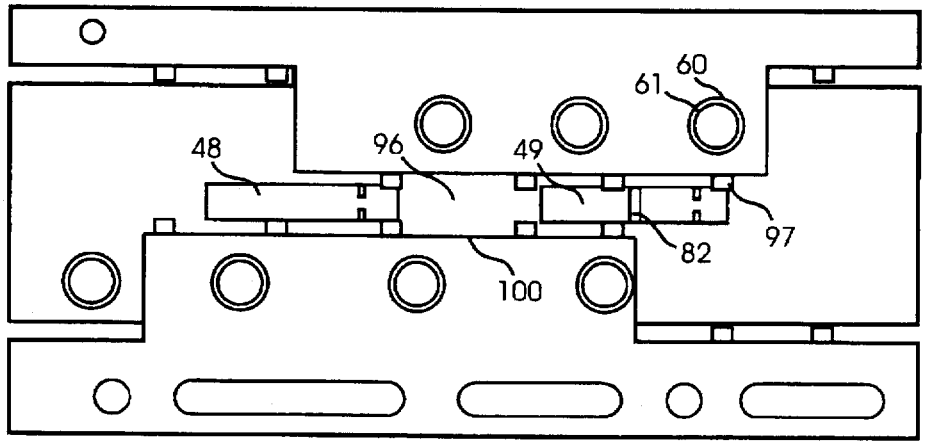
FIG. 13 is a bottom plan view of the female plate.
Figure 15:
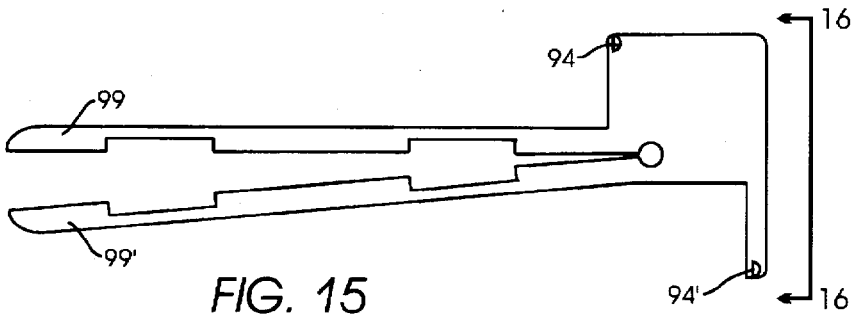
FIG. 15 is a top plan view of the T-shaped locking member.
Figure 16:
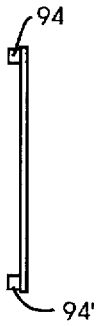
FIG. 16 is an end view of the T-shaped locking member along line 16—16 of FIG. 15.
Figure 17:
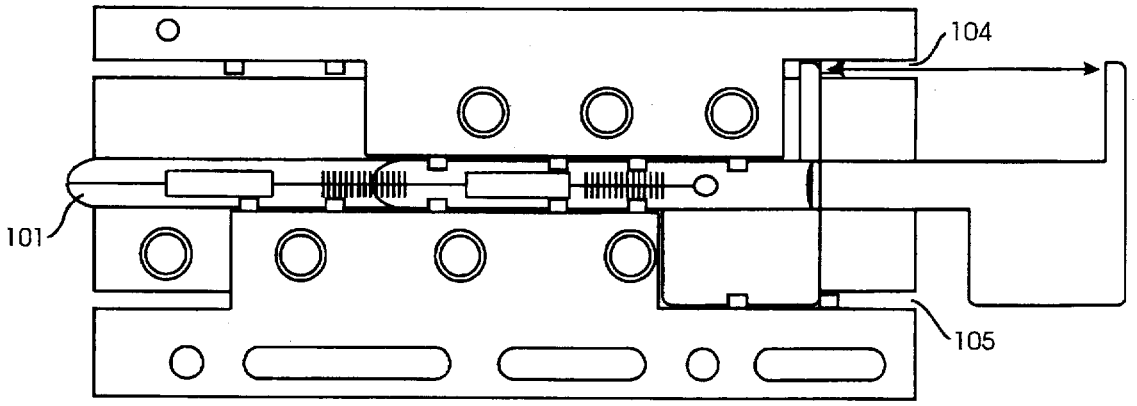
FIG. 17 is a view of the female plate shown in FIG. 13 with the T-shaped locking member in place.

The T-shaped member slides within a channel 96 provided along the bottom of the female plate as seen in FIGS. 13 and 17 and is retained by tabs 97. As seen in FIG. 6, a portion 98 of each post projects downwardly into the channel 96 when the punch is in the open position. When the punch is in its fully collapsed position, the posts are essentially horizontal and no longer project into the channel as seen in FIG. 7. When the T-shaped member is inserted to its maximal extent within the channel as shown in FIG. 17, the elongated body of the T-shaped member covers both of the slots 48,49. When the punch is fully collapsed, contact between the body of the T-shaped member and the posts prevents the posts from rotating and thereby locks the plates together in the collapsed position suitable for storage of the punch in a flat and compact configuration. The action of the T-shaped member in locking the plates in their collapsed position additionally provides a safety feature and minimizes the chance of unwanted objects being inserted between the plates to damage the cutting edges of the punch pegs. The T-shaped member is preferably made of synthetic plastic material and is molded as a centrally split unit as shown in FIG. 15 so that the sides 99,99' frictionally engage the inner edges 100 (FIG. 13) of the channel to allow positioning of the T-shaped member within the channel.

Figure 14:
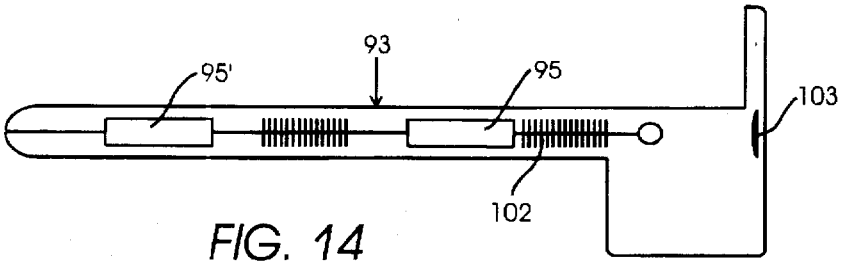
FIG. 14 is a bottom plan view of the T-shaped locking member.

As seen by a consideration of FIGS. 14 and 17, sliding the T-shaped member forward by pressing on the protruding portion 101 or by use of gripping surface 102 or depression 103 moves the member to a position which re-positions the elongated openings 95,95' thus eliminating the contact with the posts which are thereby allowed to pivot.

Longitudinal movement of the T-shaped member also allows positioning of the guide pegs 94,94' (FIG. 15,16) within the guide slots 104,105 (FIG. 17) to coincide with the desired guide lines, the guide pegs protruding from the top surface of the female plate and thereby providing end stop means for positioning sheet-like material inserted in the punch (as illustrated in FIG. 1).

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A hole punch for use by a person to manually punch holes through sheet material to produce hole sets which are appropriately sized and oriented to enable the sheet material to be mounted on a multi-ring binder, the hole punch comprising:

a male plate;

a female plate having a plurality of die openings;

peg means carried on said male plate, said peg means being insertable into respective die openings for punching holes in sheet material which is at a ready position between the peg means and the die openings; and movable support means constraining said male plate and said female plate to retain an essentially parallel orientation, said movable support means guiding movement of the male plate between an open position and a collapsed position such that movement of the male plate toward the female plate due to manual manipulation causes insertion of said pegs means into said die openings in order to produce a pattern of punched holes in said sheet material;

said movable support means comprising a plurality of parallel posts pivotally connected at one end to said male plate and pivotally connected at the other end to said female plate, at least one of said male plate and said female plate has a plurality of slots therethrough for receiving said posts as said posts rotate during the movement of the male plate toward the female plate; and, spring means urging said male plate and said female plate to return to said open position.

2. A hole punch as in claim 1 wherein said one post further includes resilient members extending transversely to the longitudinal axis of said one post so that when said one post pivots into its slot said resilient members engage said female plate providing a bias to prevent binding of said peg means in said die openings and to urge the two plates apart.

3. A hole punch as in claim 1 further including an elongated resilient member mounted transversely across at least one of said slots so that when one of said posts pivots into said one slot a side portion of said one post engages said elongated resilient member providing a bias to prevent binding of said peg means in said die openings and to urge the two plates apart.

4. A hole punch as in claim 1 wherein at least one of said posts has an edge portion juxtaposed to an edge of its slot such that convergent movement of said plates allows cutting of sheet material positioned between said juxtaposed edges.

5. A hole punch as in claim 1 further including means for locking said punch in said collapsed position comprising:

an elongated locking member having proximal and distal ends; and, means for mounting said proximal end of said elongated locking member for slidable movement longitudinally along said female plate, said elongated locking member movable to a position which prevents pivoting of at least one of said posts when said hole punch is in said collapsed position.

6. A hole punch as in claim 5 in which said elongated locking member includes guide means at the distal end for providing a stop surface which is movable to selected guide positions relative to the die openings so that an edge of the sheet material is placed against the stop surface for selective placement of the positions on the material at which the hole sets are punched by said peg means.

* * * * *